United States Patent [19]

Bersani

[11] Patent Number: 4,835,922

[45] Date of Patent: Jun. 6, 1989

[54] CONTAINER

[75] Inventor: Pierre Bersani, Bursinel, Switzerland

[73] Assignee: PARTEUROSA, Sociéte Anonyme, Luxembourg

[21] Appl. No.: 88,488

[22] Filed: Aug. 20, 1987

Related U.S. Application Data

[63] Continuation of Ser. No. 847,154, Apr. 1, 1986, abandoned.

[30] Foreign Application Priority Data

Apr. 17, 1985 [LU] Luxembourg ..... 85855

[51] Int. Cl.[4] ..... E04B 1/56

[52] U.S. Cl. ..... 52/228; 52/223 R; 52/573; 403/231

[58] Field of Search ..... 52/127.7, 127.8, 573, 52/227; 403/229, 231, 271, 272, 146

[56] References Cited

U.S. PATENT DOCUMENTS

| | | | |
|---|---|---|---|
| 3,152,421 | 10/1964 | Middendorf | 52/223 R |
| 3,203,376 | 8/1965 | Engelhardt | 52/573 X |
| 3,269,069 | 8/1966 | Carlson | 52/573 X |
| 4,145,856 | 3/1979 | Wise | 52/227 X |
| 4,338,756 | 7/1982 | Crothers | 52/573 |

FOREIGN PATENT DOCUMENTS

| | | | |
|---|---|---|---|
| 775844 | 1/1968 | Canada | 52/227 |
| 353884 | 6/1961 | Switzerland | 403/231 |
| 384824 | 2/1965 | Switzerland | 52/127.8 |
| 647965 | 12/1950 | United Kingdom . | |
| 1347177 | 2/1974 | United Kingdom . | |
| 1603613 | 11/1981 | United Kingdom . | |

*Primary Examiner*—David A. Scherbel
*Assistant Examiner*—Caroline D. Dennison
*Attorney, Agent, or Firm*—Spencer & Frank

[57] ABSTRACT

A container to be used notably as building element, comprising assembled wall elements, which are provided with first assembly arrangement which oppose disengaging of the wall elements inwardly of the container. The container further comprises second assembly arrangement for the wall elements which have a resilient force and are so arranged as to connect together the wall elements, the resilient force direction thereof being so designed as to prevent disengaging of the wall elements outwardly of the container.

9 Claims, 3 Drawing Sheets

CONTAINER

This application is a continuation of application Ser. No. 847,154, filed Apr. 1, 1986, now abandoned.

BACKGROUND OF THE INVENTION

This invention relates to a container, to be used notably as a building element and is of the type which comprises assembled wall elements and first assembly means which oppose an inward collapse of the wall elements.

Such containers are known; they further comprise a frame which supports said wall elements, and which is formed in integral beams connecting the container corners. The panel-shaped wall elements are so fastened to said frame as to fill the voids remaining between the beams (see for example UK Pat. Nos. 647,965; 1,347,177 and 1,603,613). The main drawback of such a container-like building elements lies in the frame having to absorb all by itself all the stresses acting on the container and consequently said frame has to be designed to be very strong and thus very heavy. Moreover when the panels are of a material different from that of the frame, problems of expansion factor differences arise. Due to such expansion factor difference, in critical environment conditions, for example, in case of rapid and significant temperature changes, some looseness may appear between said wall elements and frame, together with the resulting sealing deficiencies. On the other hand, breaks or permanent distortions in the wall elements may appear early, due to the expansion factor difference.

Frameless containers are also known wherein the stresses the container is subjected to, are directly absorbed in the panel unit. Such containers have the advantage of a lower weight and of lacking the drawbacks due to expansion factor differences between different materials. Such containers are simply formed by wall elements which are assembled by glueing. This assembly process involves the drawback of glue ageing. Moreover, the container which is notably designed to form a building element, should have strong and rigid walls, as the walls will be subjected to many stresses, notably the hooking of heavy apparatus on the inner surfaces of the container. It is very difficult under such conditions to make a container which takes into account these requirements and those concerning transport. Indeed, lifting containers formed by heavy wall elements which are only assembled by glueing, becomes quite a problem as regards the strength of the panel materials and the securement of the hooking elements.

It is an object of the invention to provide an improved container which does not have the above drawbacks and which may be easily transported.

SUMMARY OF THE INVENTION

Such problems are solved according to the invention, with a container as defined in the preamble which further comprises second assembly means for the wall elements which have a resilient force and are so arranged as to connect together the wall elements, the resilient force direction thereof being so designed as to prevent disengaging of the wall elements outwardly of the container.

In one embodiment of the invention, the second assembly means for the wall elements are elastically prestressed in normal environmental conditions.

In an advantageous embodiment of the invention, the container further comprises framing elements which are arranged between the container corners and some of which form said second assembly means and can, due to the resilient force thereof, absorb any expansion factor difference between the various wall elements and between said wall elements and the frame elements.

In an improved embodiment of the invention, each framing element forming a second assembly means comprises two parts which, under normal environment conditions, are spaced from one another by a predetermined axial distance, and at least one resilient element connects both parts and acts thereon to urge the two parts towards one another.

It has been found that by means of the embodiments according to the invention, it is possible to make containers which are not only tight under the most critical environmental conditions and after an extended ageing period, but which have moreover a suprisingly low weight as compared to the known containers, and have an improved mechanical strength, even in the case of containers which have framing elements. The framing elements, in some embodiments, may only be used to prevent an outwardly directed disengagement (collapse) of the wall elements and are not exposed to the outer stress forces which are for example required for lifting or conveying the container. Such forces are directly transmitted in the wall elements which are enclosed within the frame formed by the framing elements. It is thus possible to provide relatively light framing elements in angle shape, and said elements may even not be glued to the wall elements. This embodiment thus allows designing containers which are absolutely tight under critical conditions and which are to be used as building elements. The wall elements of such containers are relatively rigid and heavy per se, and the containers do not have a solid and very heavy frame as in the prior art, which makes it, easy to convey the containers.

DESCRIPTION OF THE PREFERRED EMBODIMENTS

Figure 1:
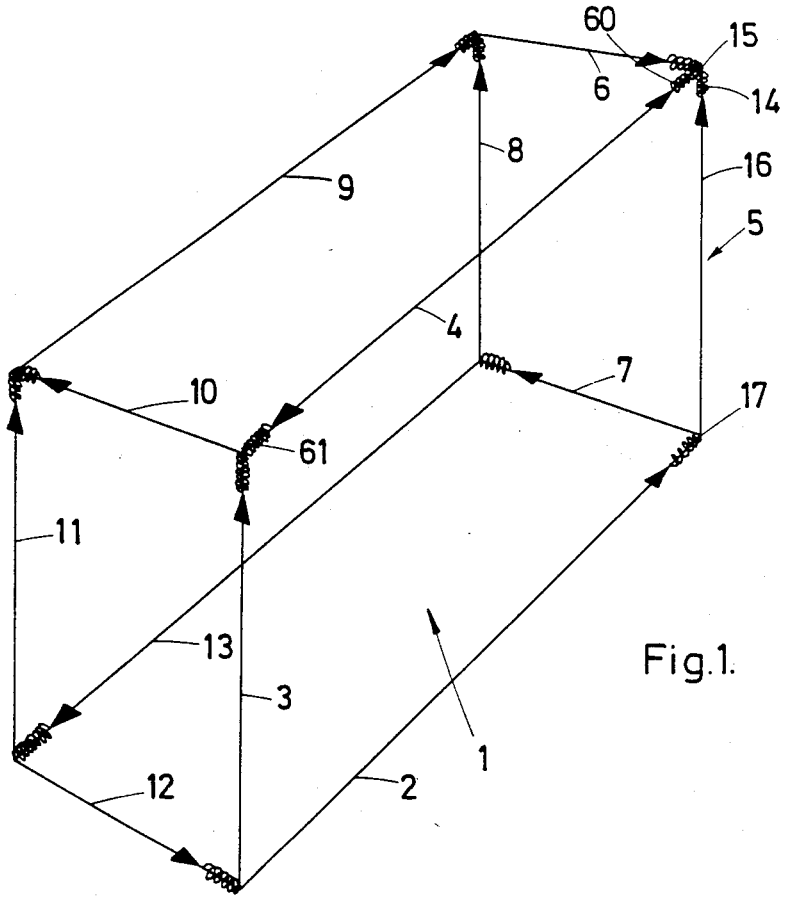
FIG. 1 shows a diagrammatic perspective view of one embodiment of the container according to the invention.

There is shown in perspective in FIG. 1, a parallelepiped-shaped container 1, which thus has six sides which schematize the wall elements forming the container body. Said wall elements are assembled together by means of first known assembly means which oppose a disengagement of the wall elements inwardly of the container. Said means generally comprise stepped element edges to allow fitting the wall elements together (see for example reference numeral 49 in FIG. 4. Said means do not, however, prevent a disengagement of the wall elements in an outward direction. Consequently, according to the prior art, the wall elements are glued together, which is insufficient due to ageing of the glues. Such aging is accentuated when the container is to be used as a building element and the wall elements themselves have a substantial weight. As previously described, there is then also provided according to the prior art, a supporting frame which is very heavy per se and which does not only support the wall elements but is also used to prevent disengagement of the wall elements. As already noted, said frame does, however, fulfill only very insufficiently such second object, notably under critical environment conditions, and it does even cause deteriorating of the erected assembly due to the expansion factor difference between the frame and the wall elements, when the components are made from different materials.

The elements 2 to 13 shown diagrammatically in FIG. 1 are second assembly means for the wall elements which in the embodiment as shown, each connect two container corners and exert a resilient force, diagrammatically shown as spiral elements 14. This results in pulling towards the one of said corners (for example corner 15 in FIG. 1), a rigid element (for example 16 in FIG. 1) which is connected to the other of said corners (for example 17 in FIG. 1). The resilient force exerted on rigid element 16 is shown with an arrow. As it may be noted, such a second assembly means is provided on each edge of the parallelepiped-shaped container. It is to be noted that it is not absolutely required to have one such means on every container edge. It is also possible to provide, on one or a plurality of container edges, a plurality of second assembly means, such as shown at 60 and 61 in FIG. 1.

Figure 2:
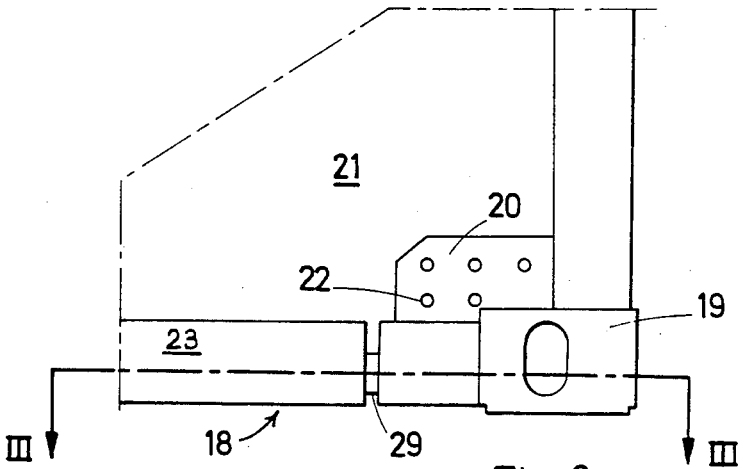
FIG. 2 shows a part elevational side view, of one embodiment of framing element according to the invention.

In FIG. 2, an actual embodiment of second assembly means is shown, wherein said means comprises a framing element 18 which is arranged between two container corners, both provided with corner elements 19 known per se. Said elements are used to couple to an external force to the container, for example when said container is to be lifted or conveyed on a boat or trailer deck.

In this embodiment, the corner element 19 is provided with plates 20 (FIG. 2) and 20' respectively (FIG. 3) which are welded thereto and which are so arranged as to cover the corner from the side wall element 21 (FIG. 2) and from the container bottom wall element, respectively, not shown in FIG. 2. Said plates are fastened to the wall element, for example, by anchoring means 22 known per se. Thus, in this embodiment, the corner element 19 is anchored directly in the wall element 21 and as it is exposed to an external force, said force is directly transmitted to the wall element 21. Said element is designed to have a strong and rigid shape to withstand such external stresses, as well as to withstand stresses originating from inside the container, for example when heavy apparatus is hooked to said wall element.

Figure 3:
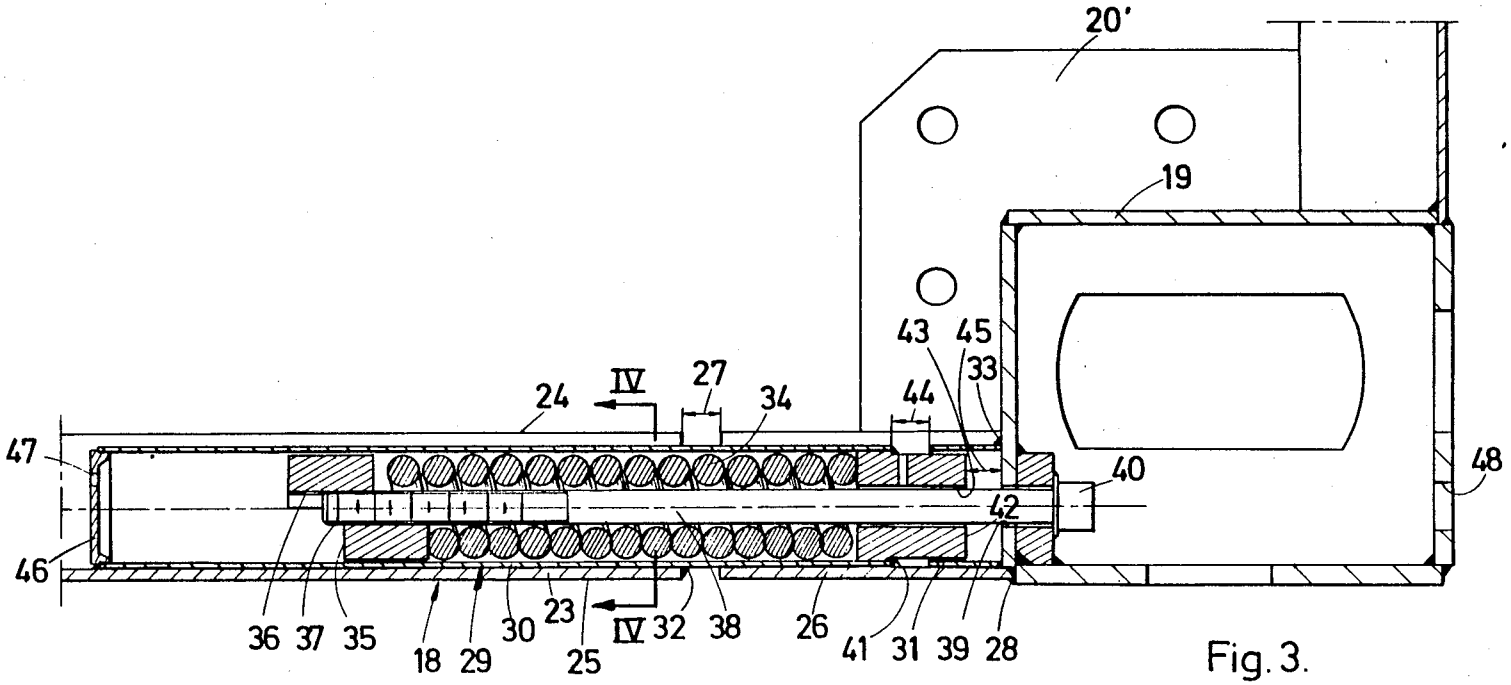
FIG. 3 shows on a larger scale, a sectional view along line III—III of FIG. 2.
Figure 4:
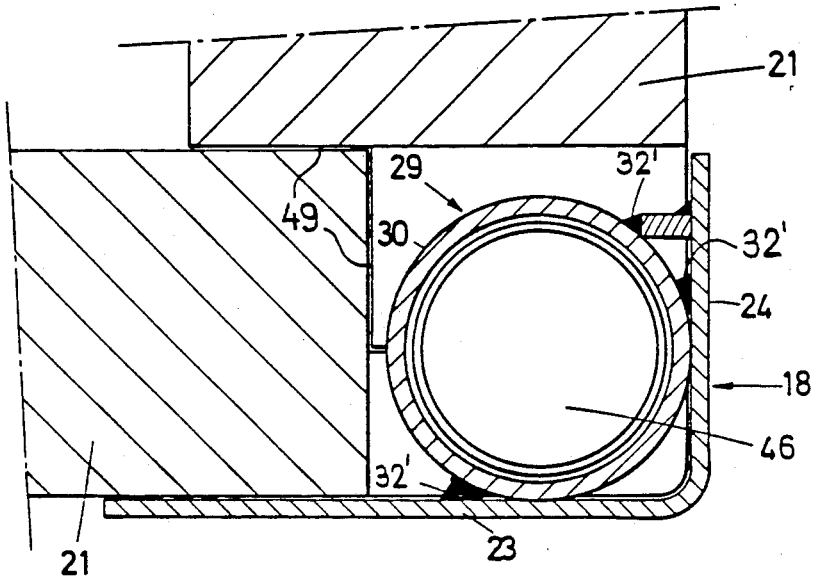
FIG. 4 shows a sectional view along line IV—IV of FIG. 3, wherein the tightening screw and the spring have been removed.

The framing element 18 is to formed, as shown in FIGS. 2 to 4, by an L-shaped angle, the flanges 23 and 24 of which enclose the container edge and which is comprised of two parts 25 and 26 spaced from one another by an axial distance 27 under normal environmental conditions.

The angle parts 25 and 26 are each fixedly connected to a corner element, for example by welding. Only the weld 28 between angle part 26 and corner element 19 is shown in FIG. 3.

Between the angle parts 25,26 a pre-stressed resilient element is arranged, which comprises a rigid-material cylinder 29 comprised of two parts 30 and 31. The part 30 is made integral with angle part 25, for example by welding at 32 (see FIG. 3), or at 32" (see FIG. 4), and the other part 31 is made integral with angle part 26, directly or through corner element 19, for example by welding thereto, as shown at 33. A pre-stressed coil spring 34 is received in part 30. The cylinder parts 30 and 31 are spaced by an axial distance 44 which is at least equal to distance 27.

Inside the cavity of cylinder part 30 there is arranged a ring-like element 35 having a screw-threaded bore 36 and being coaxial with cylinder 29. The ring-like element 35 is so arranged inside the cylinder part 30 as to make sliding relative to one another possible. The screw-threaded bore 36 cooperates with the screw-threaded end 37 of a tightening screw 38. The screw 38 passes through a hole 39 provided in the one side of corner element 19, facing cylinder 29, and passes axially through the cavity thereof. The screw 38 is threaded solely at the end 37 thereof opposite the screw head 40. The head 40 is larger than hole 39 and thus retains the ring-like element 35 at an adjustable distance from angle part 26, should a force seeking to separate the angle parts 25 and 26 be applied.

To the end of cylinder part 30 there is fixedly connected, for example, by a weld 41, a ring-like sleeve 42 the axial bore 43 of which allows passage of the unthreaded part of tightening screw 38. The end of the sleeve 42 projects axially from cylinder part 30, and the outer diameter thereof is designed to allow entering cylinder part 31 in such a way as to insure the slidability of both parts relative to one another. The projecting part of sleeve 42 has a length which is longer than the axial spacing 44 between both cylinder parts 30 and 31, and a length long enough to lie at an axial distance 45 from corner element 19, which is equal to axial distance 27.

The spring 34 is arranged inside cylinder part 30 in such a way as to engage the ring-like element 35 retained by tightening screew 38 at an adjustable distance from cylinder part 31, and to further engage the ring-like sleeve 42 secured to cylinder part 30. The ring-like element 35 and the ring-like sleeve 42 thus act as stops for spring 34.

In FIG. 3, the spring 34 is shown in the top cylinder half under normal environment conditions, but before pre-stressing is imparted thereto. The spring is thus in a relaxed condition. Advantageously, the tightening screw 38 is then so screwed as to bring the stop 35 nearer the corner element 19, which results in compressing the coil spring 34, as it appears from the lower half of FIG. 3.

In the latter spring position, the spring subjects the angle parts 25 and 26 to a tensile pre-stressing. Under normal environmental conditions, the spring is unable to bring the angle parts nearer to one another in spite of the prestressing, as the angle parts are retained by the respective corner element thereof with a spacing set by the size of the wall element. However in this position, the wall elements are exposed to the tensile action of the angle parts which thus urge the wall elements towards one another and thus prevent an outward disengagement (collapse) of the wall elements. It is to be noted that to exert such an action, the angles no longer have to be connected to the wall elements by glueing. One might even consider not connecting the wall elements by glueing together. The whole unit holds together under the effect of the resilient system, imparted by the light framing elements of the container according to the invention.

Moreover, in case of critical environment conditions, for instance when large temperature differences occur between night and day, the metal angle expands more than the wall element. Such an expansion difference is absorbed by the above-described resilient element: the long part of angle 18 moves nearer to short part 26, thus driving cylinder part 30 and stop 42 towards corner element 19. The spacing between stop 35 and stop 42 becoming wider, the spring 34 relaxes and thus absorbs the expansion difference, while preventing any danger of the angle collapsing, and it allows the framing elements to still enclose the wall elements the expansion of which has been smaller.

Cylinder part 30 is advantageously closed at the end thereof opposite corner element 19 by a cover 46, to avoiding fouling the mechanism and an opening 47 may possibly be provided in the cover 46 to allow for relief when the space between the cover 46 and stop 35 changes.

Screwing the screw 38 may be effected by a screw-driving tool which may be introduced through a passageway 48 provided in the axial extension of the tightening screw, in the one side of corner element 19.

As stated hereinbefore, in the embodiment as shown in FIGS. 2 to 4, the corner elements are directly anchored in the wall elements which are subjected to the external stresses. One might, however also consider simply glueing or even pressing the corner elements against the wall elements. In such a case the elements are integrally connected to the framing elements which are in turn glued or simply pressed on the wall elements and enclose the box formed by the wall elements by means of the pre-stressed resilient elements they are provided with.

If, however, an external force is applied to the corner elements, such force is transmitted not to the wall elements, but rather to the framing elements. It is thus then required for the resilient force of the elastic element to be selected not only as a function of the expansion factor difference present between the framing and the container body, but also as a function of any tensile force which might be coupled to the framing element with which through the corner element it is integral.

It is to be understood that this invention is not limited to the above-described embodiments and that many changes may be brought thereto without departing from the scope of the invention as defined by the appended claims.

It is for example possible to provide a resilient element, not only a coil or elastic-fibre spring, but also other spring types, such as a spring washer, or even possibly a hydraulic or pneumatic jack arrangement.

While in the description and the above embodiments, temperature changes to higher temperatures than normal have been particularly considered, it is also feasible to design a container according to the invention which is suitable for temperature changes to lower temperatures.

Moreover, as the spring reaches the maximum resilient excursion, one or a plurality of suitably arranged stops provide that the forces are transmitted directly to the structure. The strength of the stops is designed as a function of the stresses the container might be subjected to.

I claim:

1. A container of parallelepipedal shape, having six faces, twelve edges and eight corners, comprising:

(a) wall members having external surfaces forming the faces of the container;

(b) first assembly means for preventing said wall members from disengaging and collapsing in a direction inwardly of the container;

(c) second assembly means for preventing said wall members from disengaging and collapsing in a direction outwardly of the container; said second assembly means comprising a plurality of frame elements; each frame element extending along and covering a separate edge of said container from corner to corner; at least some of said frame elements being formed of first and second parts movable relative to one another in a direction parallel to an associated said edge and being normally spaced from one another by a predetermined distance; said first and second parts being movable relatively to adjacent said wall members;

(d) resilient means for urging said first and second parts toward one another in said direction parallel to an associated edge; and (e) means located at said corners for rigidly connecting to one another the frame elements converging in each said corner.

2. A container as defined in claim 1, wherein said resilient means comprises a biased spring continuously urging said two parts toward one another under normal environmental conditions.

3. A container as defined in claim 2, wherein said biased spring is in a compressed state.

4. A container as defined in claim 1, wherein said frame elements are formed of angle bars.

5. A container as defined in claim 1, wherein said means located at said corners comprises a corner fitting arranged to receive an external force.

6. A container as defined in claim 5, wherein each said corner fitting is affixed to an adjoining said wall element, and the frame elements are connected to said wall elements by means of said croner fittings.

7. A container as defined in claim 1, wherein said means located at said corners are formed of respective corner fittings arranged to transmit an external force to said container; said first and second parts of said at least some frame elements being fixedly connected to separate corner fittings; said resilient means comprising a compression spring, first and second tubular cylindrical parts affixed to said first and second parts of said at least some frame elements in a parallel orientation to a length dimension thereof; said first and second tubular parts being generally in axial alignment with and spaced from one another; said first tubular cylindrical part extending into a respective said second part and being slidable relative thereto; a first stop situated in said first tubular cylindrical part and being affixed thereto; a second stop situated in said first tubular cylindrical part and being longitudinally adjustably connected to said second tubular cylindrical part; said compression spring being situated within said first tubular cylindrical part between said first and second stops; said first and second stops being arranged to compress said compression spring for continuously urging said first and second parts toward one another in said direction parallel to an associated said edge under normal environmental conditions.

8. A container as defined in claim 7, wherein said frame elements are formed of angle bars, and said first and second parts are each formed of respective first and second angle bar parts.

9. A container as defined in claim 5, wherein said corner fitting is independent from and adjacent to said wall members.

* * * * *